United States Patent [19]

Vidal et al.

[11] Patent Number: 4,982,550

[45] Date of Patent: Jan. 8, 1991

[54] JOINING OF A CONCRETE ELEMENT TO A SUPPORT

[75] Inventors: Henri Vidal, 8 bis, Boulevard Maillot, 92200 Neuilly-sur-Seine, France; Santiago Muelas-Medrano, Madrid, Spain

[73] Assignee: Henri Vidal, Neuilly-sur-Seine, France

[21] Appl. No.: 350,906

[22] Filed: May 12, 1989

[30] Foreign Application Priority Data

May 13, 1988 [GB] United Kingdom ..... 8811377

[51] Int. Cl.[5] ..... E04B 1/38

[52] U.S. Cl. ..... 52/747; 52/295

[58] Field of Search ..... 52/136, 137, 235, 295, 52/396, 477, 698, 747

[56] References Cited

U.S. PATENT DOCUMENTS

| | | | |
|---|---|---|---|
| 2,587,724 | 3/1952 | Henderson | 52/295 X |
| 3,125,190 | 3/1964 | Brennan | 52/698 X |
| 3,300,929 | 1/1967 | Fischer | 52/698 X |
| 3,829,540 | 8/1974 | Cox | 52/295 X |
| 4,162,596 | 7/1979 | Damman | 52/295 |

*Primary Examiner*—David A. Scherbel
*Assistant Examiner*—Jerrold D. Johnson
*Attorney, Agent, or Firm*—Burns, Doane, Swecker & Mathis

[57] ABSTRACT

A concrete facing panel is joined to a counterfort by means of a pair of bolted joints. Each joint comprises a hole in the panel through which a bolt projecting from the counterfort passes, and a nut mounted on the threaded end of the bolt. A resilient plug is located in the hole at its end facing the counterfort to form a first watertight seal, the plug including an integral spacing ring to space apart the panel and the counterfort. A second watertight seal is provided by a layer of epoxy resin applied over the nut.

7 Claims, 3 Drawing Sheets

JOINING OF A CONCRETE ELEMENT TO A SUPPORT

This invention concerns improvements in or relating to the joining of a concrete element to a support.

It is a general practice in the construction of reinforced concrete structures to connect elements of the structure to each other by casting one element e.g. a counterfort with reinforcing bars protruding therefrom and then casting the next element e.g. a facing so as to embed the protruding bars. In this way the elements are permanently secured together in a rigid manner with the reinforcing bars protected by their concrete cover from the effects of rain, ground water and so forth.

An alternative method of connecting a concrete element to another concrete element or to another member such as a steel girder is by the use of bolts. The problem with a simple bolted connection is that water can penetrate through to the metal bolt and lead to corrosion problems. Concrete can absorb a limited amount of water and release this over a period of time into the air space surrounding the bolt, thus providing ideal conditions for corrosion. Furthermore, if the concrete element has surface irregularities it is not easy to avoid excessive pressure between raised areas on the abutting surfaces or to ensure that this concrete element is correctly positioned by the bolted connection relative to the other member. Such joints are not normally thought to be as strong or rigid as an integrally cast connection since stresses are concentrated in the region of the bolt and the security of the structure depends on the continued tensile strength of the bolt. Thus, any corrosion of the bolts can lead to serious weakening of the structure.

Viewed from a first aspect the invention provides a method of joining a concrete element to a support, comprising forming the concrete element with a hole through which a bolt projecting from the support passes, mounting fixing means on the bolt to secure the concrete element to the support with a spacer being located therebetween, wherein a resilient annular plug is located in the hole at its end facing the support and surrounds the bolt to form a first substantially watertight seal, and wherein the end of the hole remote from the support is provided with a second substantially watertight seal.

Viewed from another aspect the invention provides in a structure having a concrete element joined to a support, a joint comprising a bolt projecting from the support and passing through a hole formed in the concrete element, fixing means mounted on the bolt to secure the concrete element to the support, a spacer located between the concrete element and the support, an annular plug located in the hole at its end facing the support and surrounding the bolt to form a first substantially watertight seal, and a second substantially watertight seal at the end of the hole remote from the support.

With such arrangements the hole is sealed at both ends so that water cannot penetrate into the hole and thus lead to corrosion problems. The resilient annular plug serves to locate the concrete element relative to the support by virtue of its engagement in the hole. At the same time, the spacer between the concrete element and the support prevents these two members from coming into direct contact and thus ensures that they can be joined together in the correct positions without surface irregularities of the concrete element interfering with the joint. Thus the concrete element, for example a facing panel of a counterfort wall, can be quickly and effectively joined to a support, for example a counterfort, by a joint protected from the intrusion of water.

It may be possible to position the spacer between the concrete element and the support at a location separate from the other parts of the joint, but preferably the spacer is in the form of a ring extending round the plug thereby ensuring that the desired spacing is provided at least in the region of the plug. The spacer may for example be a separate ring which is placed round the plug, but preferably the spacer is integral with the plug so as to form a one piece unit which both seals the hole and spaces the concrete element from the support. Such a one piece unit is particularly advantageous since it performs both sealing and spacing functions.

The plug may be arranged to mate with the surface of the concrete element from which the bolt projects and thus form a seal with this surface. In a preferred arrangement the support has a recess into which the plug extends. This can ensure that the plug is accurately positioned relative to the support and forms a particularly good seal therewith. If the support is also formed of concrete then it may be cast with a portion of the plug embedded in the concrete and a portion projecting outwardly for engagement in the hole of the concrete element. In such circumstances the bolt will normally have a base portion which is also embedded in the concrete during casting so as to be firmly anchored, the base portion of the bolt within the concrete preferably being bent at least once, and more preferably twice, to ensure good anchorage thereof.

The plug may be cylindrical or some other convenient shape and will normally be located in the hole with a force fit. This not only compresses the resilient material of the plug firmly against the side walls of the hole but also against the sides of the bolt to provide a secure water seal. The plug is preferably of tapering configuration, being smallest where it projects into the hole and increasing in size in the direction towards the support. This facilitates engagement of the hole in the concrete element with the plug. Furthermore when the plug is extended into a recess in the support as mentioned above its tapering configuration assists the plug in remaining in the recess.

In a preferred embodiment the hole is lined by a plastics sleeve arranged to surround the bolt and having an enlarged diameter at the end of the hole which faces the support, the plug being located between the bolt and the sleeve. The sleeve which may be of PVC provides further protection against moisture for the bolt while its portion with an enlarged diameter provides an opening into which the plug can be inserted. A further advantage of the sleeve is that direct contact between the wall of the hole in the concrete and the bolt is avoided, so that during assembly the bolt does not chip or crack the concrete as the concrete element and support are moved together.

The second substantially watertight seal at the end of the hole remote from the support may take a number of forms. For example the fixing means and any protruding part of the bolt may simply be coated with a suitable waterproof material. Preferably the fixing means is a nut which is covered by a waterproof adhesive applied to the nut and to the region of the concrete element around the nut, and a cap is secured in position by said adhesive. While the cap provides additional protection for the joint in many cases it will also serve as a decorative element.

The resilient plug may be formed of any suitable material and a particularly good seal is obtained by the use of neoprene. The bolt will normally be formed of steel which is preferably galvanised for additional protection.

It will thus be seen that use of a waterproof bolted joint between a concrete element spaced from a support has several advantages over simple bolted joints previously proposed. In fact, there are certain types of concrete structure, namely counterfort walls, in which the practice has always been to use steel reinforcement projecting from a previously cast element to form a connection with the next element to be cast, so that the use of a bolted connection is of itself a major advance in the art. Previous practice has been to cast a counterfort, or more usually a pair of counterforts, with steel reinforcement projecting therefrom, and then once the concrete has hardened a facing is cast to form an integral unit with the counterfort(s). The shuttering for the facing must be accurately positioned and while this is time consuming there are further delays in waiting for the concrete which forms the facing to harden and in removing the shuttering. Further, since a typical wall has a height of 10 m it is not usually practical for the casting to take place in the final position of use. Thus each counterfort is normally arranged horizontally while the facing is cast and eventually the whole unit which has considerable weight must be lifted to the vertical position by a crane. At this stage it has been found to be virtually impossible to avoid small knocks which chip away the concrete at any corners and edges and lead to cracks and other imperfections. If the damage is excessive it is sometimes necessary to discard the whole unit. However these problems have been thought to be unavoidable in view of the requirement to erect a sound structure in which the counterfort and the facing form an integral reinforced concrete unit.

We have now discovered that many of the problems of the prior art can be substantially eliminated by forming the facing by bolting one or more prefabricated facing panels to the counterfort(s). Thus viewed from a further aspect the invention provides a structure having a footing and prefabricated concrete elements which comprise at least one counterfort and at least one facing panel, each of such panel or panels being attached to the counterfort or counterforts by at least one bolted joint, and each joint comprising a bolt cast into and projecting from one of the prefabricated elements and through a hole formed in the other prefabricated element, fixing means, such as a nut, being mounted on the free end of the bolt to secure the prefabricated elements together. Normally, the facing panels will be bolted to at least two substantially parallel counterforts. It is preferred to use a plurality of panels attached to each counterfort, in order to reduce the weight of each individual panel.

With such an arrangement the prefabricated panel(s) can be relatively quickly and accurately attached to the counterfort(s) on site, while the joints provide the required degree of strength and rigidity. In general, assembly on site takes less space than the casting method since no moulds or shuttering are required and since the individual elements are all normally flat, transport is greatly facilitated as compared with monolithic counterfort wall units.

The panels may be attached with the counterfort in the final, vertical position of use, but in practice the counterfort will normally be arranged horizontally during attachment of the panels. If any panels are then damaged when the whole unit is lifted by a crane or otherwise to the vertical position, the individual damaged panels can be replaced as necessary, rather than discarding the whole unit.

The panels will normally be prefabricated away from the site and are preferably protected from knocks during storage and transport by suitable packaging. The structure will normally comprise a plurality of counterforts in a row and these counterforts may also be prefabricated and packaged for protection in the same way.

A further advantage is that a large number of identical panels can be prefabricated and used in walls of different height. Only a few of the panels, for example those used at the top of the structure, may need to be of different configuration. The panels may be provided with grooves, striations, coloring or other markings so as to give the structure a striking or attractive appearance such as patterns when a plurality of panels make up the facing. A typical panel may be rectangular e.g. 2.0 m by 1.0 m and their abutting edges may be separated by a strip of water seal material. The abutting edges may conveniently be keyed to provide an interlocking surface which may help to reduce water seepage.

The panels may be provided with a rearwardly projecting bolt and the counterfort may have a hole in its front edge ending in a recess accessible from the side to permit the nut to be mounted on the bolt of the panel. Preferably however the bolt projects from the front edge of the counterfort and the panel is formed with the hole, the nut being mounted on the bolt at the front of the panel. Two joints between each panel and each counterfort are normally sufficient.

The joints between the facing panels and the counterfort may include any of the features previously described.

Certain preferred embodiments of the invention will now be described by way of example and with reference to the, accompanying drawings in which.

Figure 1:
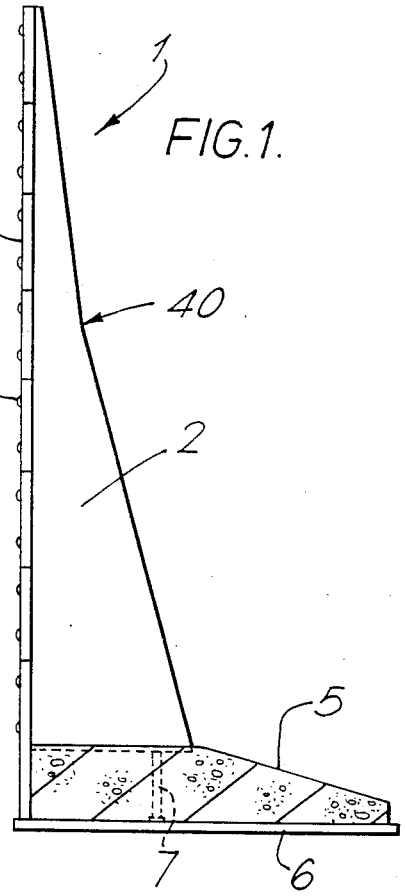
FIG. 1 shows a side elevation, partly in section, of a structure comprising a counterfort wall having a plurality of panels joined to a counterfort.

Referring to FIG. 1, the counterfort wall 1 comprises a counterfort 2 to which a plurality of facing panels 3 are attached by bolted joints 4, and a footing 5 for supporting the wall. The footing rests on a distribution plate 6 which is also engaged by the lowermost facing panel 3. An erection bolt 7 extends between the distribution plate and the counterfort 2 and is arranged so that during construction a nut on the bolt is raised or lowered to adjust the orientation of the unit consisting of the counterfort and panels. Once the correct adjustment is made the footing 5 is cast and embeds reinforcing bars (not shown) protruding from the bottom of the counterfort. The rear face of the counterfort includes a bend 40 which provides savings in the amount of concrete used.

Figure 2:
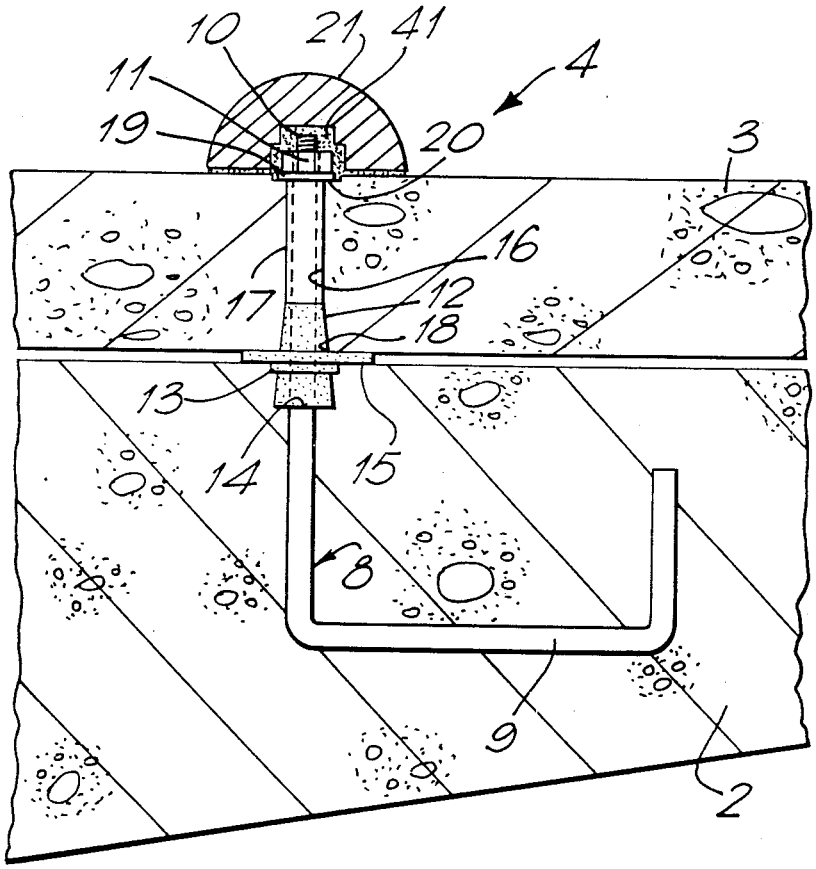
FIG. 2 shows a section through a typical joint between a panel and a counterfort.

FIG. 2 shows in detail one of the bolted joints between the counterfort 2 and one of the panels 3. A bolt 8 has a base portion 9 which is precast into the counterfort and which is bent twice through 90° for firm anchorage. The bolt projects outwardly from the counterfort and has at its free end a threaded portion 10 which is engaged by a nut 11. During casting of the counterfort a resilient annular plug 12 is arranged to surround the bolt 8 and is formed along its length with a shoulder 13 for assisting in correctly positioning the plug as the counterfort is cast. The plug thus causes a recess 14 to be formed in the concrete and since the plug is of tapered configuration it tends to stay in this recess once the concrete has hardened.

The plug also has an integral spacing ring 15 adjacent the shoulder 13 and arranged to space apart the counterfort 2 and the panel 3.

The facing panel 3 is formed with a hole 16 which is lined by a plastics e.g. PVC sleeve 17 of diameter slightly greater than that of the bolt 8. The sleeve has a funnel shaped portion at the end of the hole which faces the counterfort and thus is widened at its opening 18 where the plug is received. This opening is in fact slightly smaller than the part of the plug which is inserted therein, resulting in resilient deformation of the plug and assisting the quality of the seal.

At the front face of the panel 3 a washer 19 sits in a recess 20 of the panel and the nut 11 is tightened onto the washer to secure the panel to the counterfort. Such tightening may be effected by a torque wrench or the like. A layer of epoxy resin 41 is applied over the nut, the protruding threaded portion 10 of the bolt and an annular zone around the bolt on the face of the panel to form a waterproof seal. The seal is assisted further by a decorative cap 21 adhered to the epoxy resin.

Figure 4:
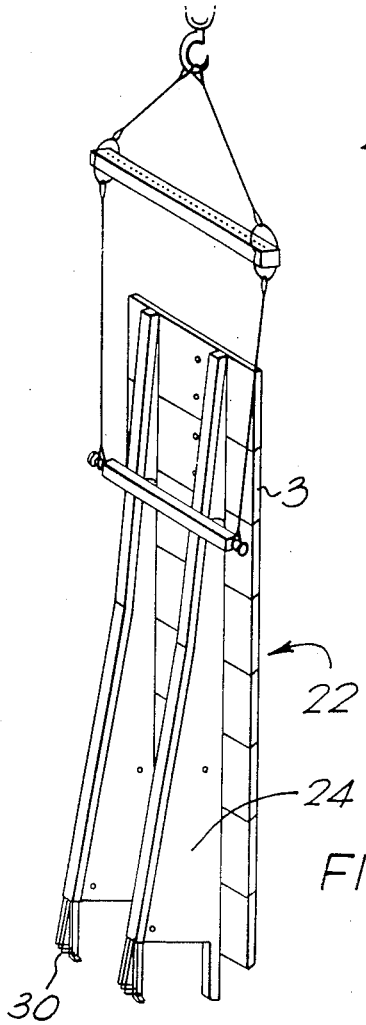
FIG. 4 shows the completed assembly of FIG. 3 being lifted into position.
Figure 3:
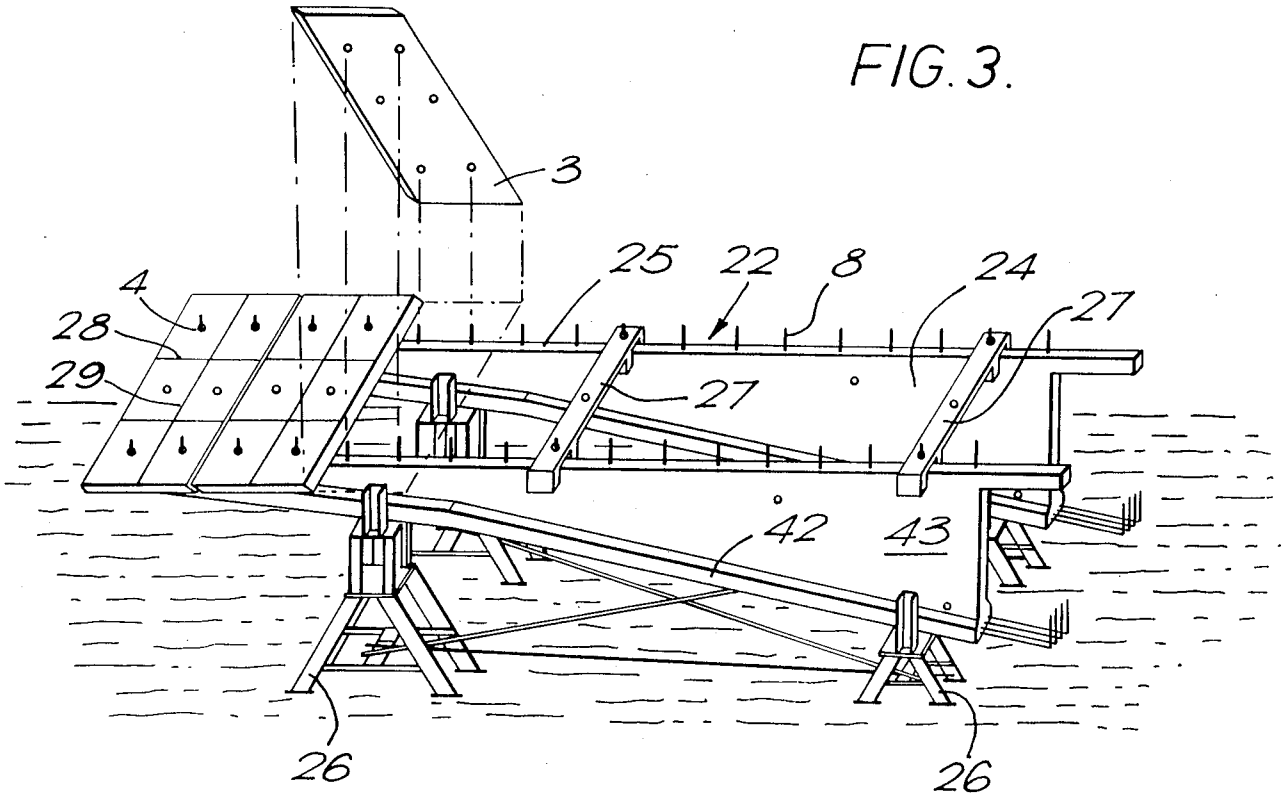
FIG. 3 shows one stage during assembly of another embodiment a counterfort wall.

FIGS. 3 and 4 illustrate a second embodiment in which a unit 22 is made up of prefabricated facing panels 3 bolted to a pair of counterforts 24 by means of bolts 8 which protrude at intervals from the front surface 25 of the counterforts. Each counterfort is made of reinforced concrete and has a rear thickened flange 42 integral with a thinner web 43. The counterforts are held by their flanges on suitable supports 26 and temporary braces 27 are used to maintain their front portions at the correct spacing while the panels 3 are bolted into position at joints 4. Each panel includes four joints for this purpose, and in the illustrated embodiment the panels also have grooves 28 and recesses 29 on their front faces to provide a rusticated facing.

Once assembly of the unit 22 is complete it may be hoisted by a crane or the like to a vertical position, as shown in FIG. 4. Once the unit is correctly positioned, the reinforcing bars 30 projecting from the bottom of the unit are embedded in concrete cast to form the footing of the retaining wall.

An example of a counterfort in accordance with the preferred embodiments has a height of 10 m and is intended to retain an earth mass having a specific gravity of 1.8 and a coefficient of thrust of 0.33. Thus for a lower panel the force on one square metre of panel will be $F=0.33\times10\times1.8\times9.8=58$ kN. Using as the bolt a 14 mm steel bar with an effective diameter in the region of the nut of 12 mm and an elastic limit of 5100 kg/cm$^2$, the force required to reach the elastic limit of the bolt is in general 56 kN. The panel has dimensions 2.0 m by 1.0 m and is connected to two counterforts, two bolts for each counterfort. Thus, the theoretical factor of safety against reaching the elastic limit is $(56\times2)/58$ which is approximately equal to 2. If there are three counterforts, and altogether six bolts, this value will be 3.

These values are theoretical in that in practice counterforts of height 10 m have a significant rear edge which creates a certain arching effect in the soil which reduces the actual pressure of earth on the panel. Tests have been carried out to confirm these calculations.

We claim:

1. A method of joining a concrete element to a support, comprising forming the concrete element with a hole through which a bolt projecting from the support passes, mounting fixing means on the bolt to secure the concrete element to the support with a spacer being located therebetween, wherein a resilient annular plug is located in the hole at its end facing the support and surrounds the bolt to form a first substantially watertight seal, and wherein the end of the hole remote from the support is provided with a second substantially watertight seal.

2. A method as claimed in claim 1, wherein the spacer is in the form of a ring extending round the plug.

3. A method as claimed in claim 1, wherein the spacer is integral with the plug so as to form a one piece unit which both seals the hole and spaces the concrete element from the support.

4. A method as claimed in claim 1, wherein the support has a recess into which the plug extends.

5. A method as claimed in claim 1, wherein the plug is of tapering configuration, being smallest where it projects into the hole and increasing in size in the direction towards the support.

6. A method as claimed in claim 1, wherein the hole is lined by a plastics sleeve arranged to surround the bolt and having an enlarged diameter at the end of the hole which faces the support, the plug being located between the bolt and the sleeve.

7. A method as claimed in claim 1, wherein the fixing means is a nut which is covered by a waterproof adhesive applied to the nut and to the region of the concrete element around the nut, and a cap is secured in position by said adhesive.

* * * * *